US008763994B2

(12) United States Patent
Seremetis et al.

(10) Patent No.: US 8,763,994 B2
(45) Date of Patent: Jul. 1, 2014

(54) HUMIDIFIER WITH ULTRASONIC TRANSDUCER

(76) Inventors: Peter Seremetis, Mount Prospect, IL (US); Rosario Milana, Algonquin, IL (US); Clifford Hedquist, Lisle, IL (US)

( * ) Notice: Subject to any disclaimer, the term of this patent is extended or adjusted under 35 U.S.C. 154(b) by 226 days.

(21) Appl. No.: 13/366,254

(22) Filed: Feb. 3, 2012

(65) Prior Publication Data

US 2013/0200536 A1 Aug. 8, 2013

(51) Int. Cl.
*B01F 3/04* (2006.01)

(52) U.S. Cl.
USPC ..... 261/30; 261/81; 261/119.1; 261/DIG. 65

(58) Field of Classification Search
CPC ..... B01F 3/04; B01F 3/02; B01F 3/022; B01F 3/04021; B01F 3/0407
USPC ..... 261/30, 81, 119, DIG. 65
See application file for complete search history.

(56) References Cited

U.S. PATENT DOCUMENTS 8,128,069 B2 * 3/2012 Reens ..... 261/30

* cited by examiner

*Primary Examiner* — Robert A Hopkins
(74) *Attorney, Agent, or Firm* — R. Elliott Halsey

(57) ABSTRACT

A humidifier has a continuous water flow system with total water recovery and no loss, for maximum efficiency. The unit has a fan with a motor, a transformer, and a circuit hoard, a water tank, and a hood that directs the water vapor into a duct system of a residence. The unit uses multiple ultrasonic transducers positioned at the bottom of a water chamber that transform electrical energy into mechanical energy through vibration. The vibration excites the water molecules separating them into particles having a diameter of about 10 microns for circulation through a home.

1 Claim, 2 Drawing Sheets

HUMIDIFIER WITH ULTRASONIC TRANSDUCER

BACKGROUND OF THE INVENTION

1. Field of the Invention

This invention relates generally to humidifiers, and specifically relates to an atomizer that sprays out liquid utilizing a piezoelectric element.

2. Description of the Related Art

The primary issue to overcome in the prior art humidifiers are those associated with excess moisture left over in the humidifier. The prior art residential humidifiers commonly cause problems associated with excess moisture, such as damage to the duct system from water film and water-born mineral deposits. Also, introducing excessive moisture amounts into room air may be a risk to human health due to excess stagnant water serving as microbe reservoirs.

The prior art strives to balance the need for moisture in the residential home air system, yet avoid the problems resulting from excess water. There is a need in the prior art for a humidifier apparatus that utilizes a method whereby the smallest possible water vapor droplet is distributed throughout an entire residential living space in an energy-efficient manner.

BRIEF SUMMARY OF THE INVENTION

The present invention is a residential humidifier having multiple ultrasonic transducers positioned at the bottom of a water chamber. Piezoelectric transducers transform electrical energy into mechanical energy through vibration. The vibration excites the water molecules separating them into particles having a diameter of about 10 microns. The result is a water vapor layer above the water surface, thereby generating a cool mist of water particles for circulation through a home.

Figure 1:
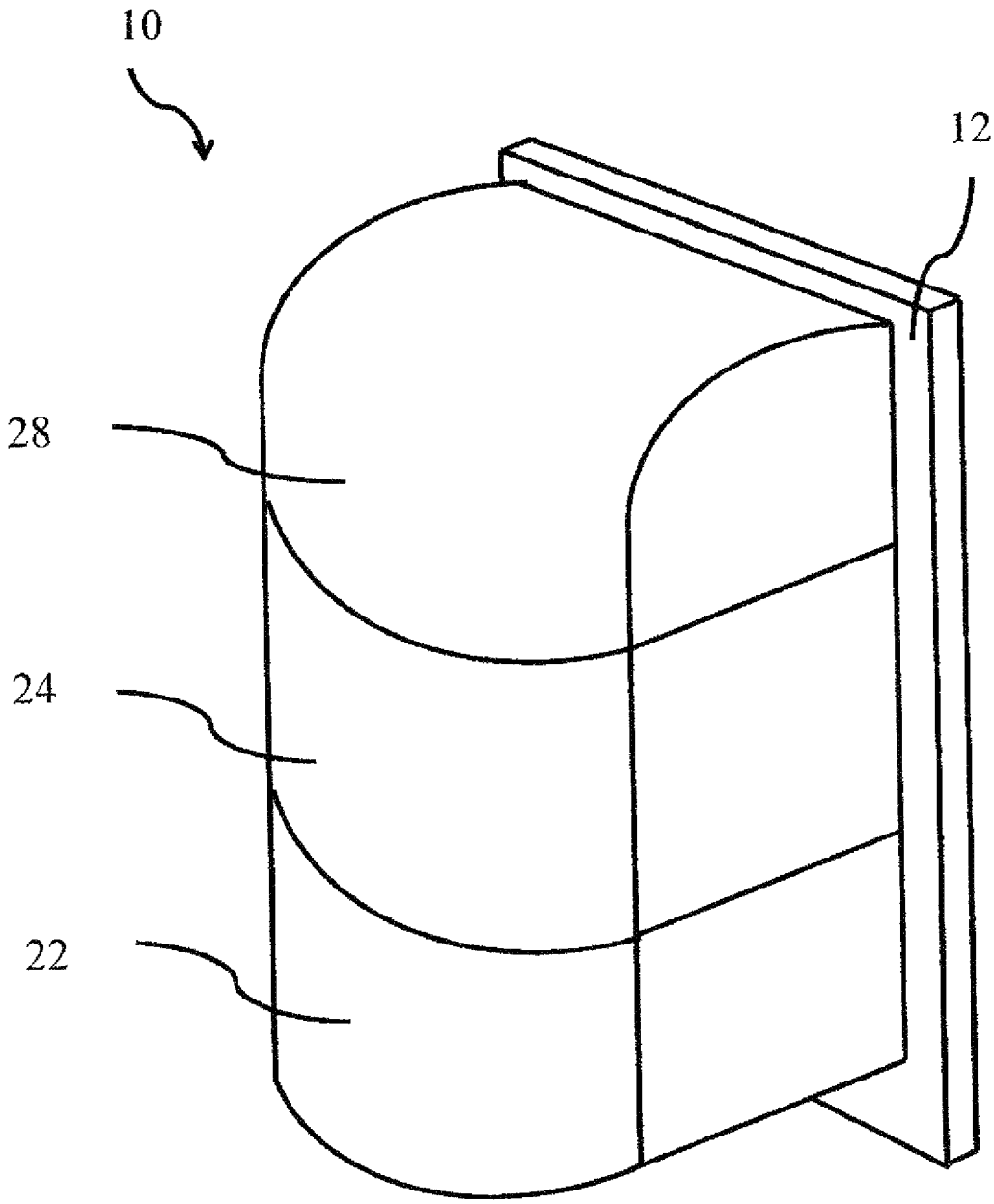
FIG. 1 is a top view in perspective of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose

DETAILED DESCRIPTION OF THE INVENTION

Looking at FIG. 1, the humidifier 10 includes a U-shaped air/water chamber 24, a U-shaped cover 22, and a deflector cover 28 secured to a back plate 12. The covers 22, 24 and 28 protect respective U-shaped recesses.

Figure 2:
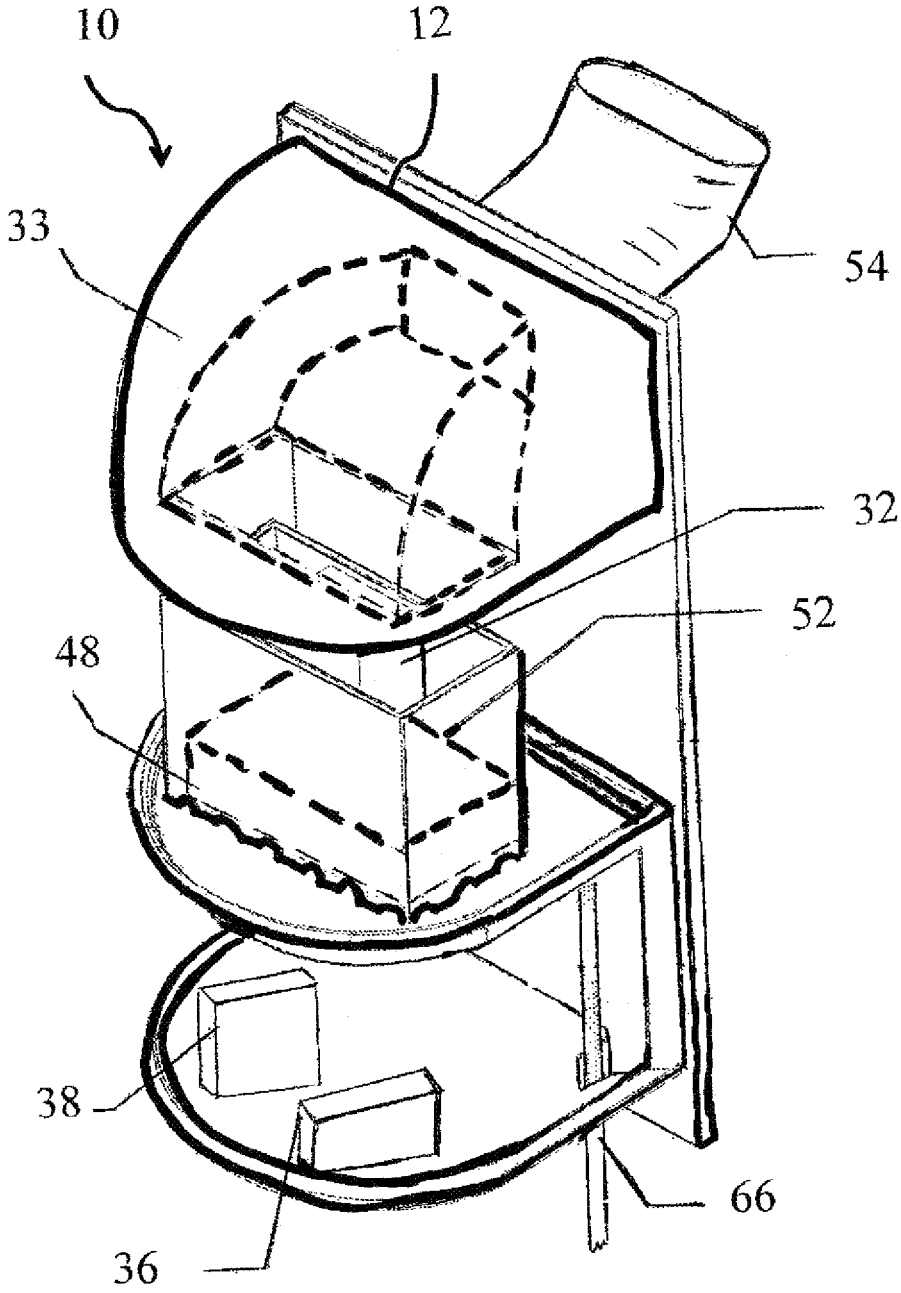
FIG. 2 is a view in perspective of the disassembled invention displaying inside components.

As seen in FIG. 2, the U-shaped recesses behind house electronic components, including a fan 32, a step-down transformer 36 with a single primary winding and a single secondary winding with taps located only at the ends of the windings, and a circuit board 38. The fan 32 is positioned under an enclosed air hood 33. The fan 32 forces air upwardly through the air hood 33. The electronic components 32, 36, and 38 are connected to a 110 volt AC supply, which in the preferred embodiment is an electrical cord which extends through a conduit opening in a lower transverse wall 16.

As seen in the FIG. 2, the humidifier 10 includes at least one piezoelectric transducer 48. The transducer vaporizes water held in the air-water chamber 52. Air is directed upwardly in the air hood 33, which extends rearward to a duct diffuser 54. The piezoelectric transducer 48 is submerged under water in the chamber 52. A corrugated bottom surface of the chamber 52 is wider than the air hood 33 so that after the air strikes the water, the air flows upward through the hood 33 housed in the deflector cover 28. In the preferred embodiment, an O-ring gasket or similar standard means is used to seal the joint between the air hood 33 and the deflector 54 to prevent leakage of the humidifier air.

The air hood 33 within the deflector cover 28 directs the air from into the duct diffuser 54. The duct diffuser 54 is inserted in a plenum duct (not shown) of the house and disperses humidifier air into the HVAC system of a house. The air/water chamber 52 is connected to the house water line by a water feed line 66 and a water drain line (not shown) positioned opposite the feed line 66. Each of the water feed and drain lines 66 is equipped with a solenoid valve (not shown). The water feed and drain lines 66 are coupled to the air/water chamber 52.

The air/water chamber 52 is equipped with a water level control system (not shown) comprising a low water level sensor (LWL sensor), a float switch, and an overflow sensor (OF sensor) to maintain a sufficient water supply to the piezoelectric transducer 48. The feed line solenoid valve communicates with the LWL sensor and the float switch. The drain line solenoid valve communicates with the OF sensor. Further, the piezoelectric transducer 48 is manufactured with a low water level sensor which, if triggered, shuts off the piezoelectric transducer 48. The LWL sensor, float switch, and OF sensor are located at 0.25 to 0.5 inch, 1.75 to 2.0 inches, and 2.5 to 2.75 inches above the piezoelectric transducer 48, respectively.

The LWL sensor and float switch operate together to ensure the piezoelectric transducer 48 is continuously submerged during operation. The water level drops as the piezoelectric transducer 48 causes water to vaporize. When the water level drops to or below the LWL sensor, the feed line solenoid valve is opened and allows water to flow into the air/water chamber 52. When the water level reaches the float switch, the feed line valve is closed, and stops the water from flowing into the air/water chamber 52. Under normal operation, the water level varies between the elevations of the LWL sensor and the float switch.

As a precaution, the OF sensor and the piezo sensor are provided as a back-up if the LWL sensor or the float switch fail. If the water level falls below the LWL sensor and continues to drop, the piezo sensor eventually emerges from the underwater and shuts off the piezoelectric transducer 48 to prevent burn out of the piezoelectric transducer 48. The piezo sensor detects the presence or absence of water at a particular level, and does not detect an amount of water on or in contact with the piezoelectric transducer 48.

Alternatively, if the float switch fails to cause the feed line solenoid valve to close and the water level continues to rise, the OF valve opens the drain line solenoid valve and causes water to flow out of the air/water chamber 52 to prevent flooding therein.

While certain preferred embodiments of the present invention have been disclosed in detail, it is to be understood that various modifications may be adopted without departing from the spirit of the invention or scope of the following claims.

The invention claimed is:

1. An ultrasonic air humidifying apparatus comprising:

(A) a U-shaped air/water chamber, a U-shaped cover securable over a U-shaped recess, a deflector cover secured to a back plate, and a deflector secured to said air/water chamber;

(B) said U-shaped recess housing electronic components including a fan, a fan motor, a step-down transformer having a single primary winding and a single secondary winding with taps located only at the ends of said windings, and a circuit board, said fan positioned in proximity to an upper air opening in a transverse wall;

(C) a lower air opening in said transverse wall having a filter to enable said fan to withdraw air through said recess, said electronic components being connected to a 110 volt AC supply by a series of electrical cords extending through a conduit opening in said lower transverse wall;

(D) at least one piezoelectric transducer in said air/water chamber, said piezoelectric transducer having a low water level sensor;

(E) first and second ducts adjacently positioned alongside one another with said first duct extending into said second duct, said first duct being coupled to said upper air opening, a corrugated bottom surface of said second duct being wider than said first duct, and an O-ring gasket positioned between said second duct and said deflector;

(F) said air/water chamber in connection to a house water line by a water feed line and a water drain line, each of said water feed and drain lines being equipped with a solenoid valve and fed through a conduit opening said in the lower transverse wall and coupled to said air/water chamber at said upper transverse wall adjacent said back plate;

wherein said air/water chamber is equipped with a water level control system comprising a low water level sensor positioned at 0.25 to 0.5 inch, a float switch positioned at 1.75 to 2.0 inches, and an overflow sensor 2.5 to 2.75 inches above said piezoelectric transducer and said feed line solenoid valve is in communication with said low water level sensor and the float switch, and said drain line solenoid valve communicates with said overflow sensor so said low water level sensor, float and piezoelectric transducer can be triggered to deactivate said the piezoelectric transducer.

* * * * *